US012687083B2

(12) United States Patent
Johnson et al.

(10) Patent No.: US 12,687,083 B2
(45) Date of Patent: Jul. 21, 2026

(54) VENT SUB FOR LUBRICATOR

(71) Applicant: Downing Wellhead Equipment, LLC, Oklahoma City, OK (US)

(72) Inventors: Austin Johnson, Edmond, OK (US); Justin Lewis, Arcadia, OK (US); John Dyer, Norman, OK (US); Jordan Kuehn, Forest Park, IL (US)

(73) Assignee: Downing Wellhead Equipment, LLC, Oklahoma City, OK (US)

( * ) Notice: Subject to any disclaimer, the term of this patent is extended or adjusted under 35 U.S.C. 154(b) by 346 days.

(21) Appl. No.: 18/158,867

(22) Filed: Jan. 24, 2023

(65) Prior Publication Data

US 2024/0247755 A1 Jul. 25, 2024

(51) Int. Cl.
*E21B 33/068* (2006.01)

(52) U.S. Cl.
CPC ..... *E21B 33/068* (2013.01)

(58) Field of Classification Search
CPC ..... E21B 33/068; E21B 33/072
See application file for complete search history.

(56) References Cited

U.S. PATENT DOCUMENTS

| | | | | |
|---|---|---|---|---|
| 10,584,552 | B2 | 3/2020 | Cannon et al. | |
| 10,689,938 | B2 | 6/2020 | Beason et al. | |
| 11,053,767 | B2 | 7/2021 | Cannon et al. | |
| 11,242,724 | B2 | 2/2022 | Young et al. | |
| 11,473,399 | B2 | 10/2022 | Beason et al. | |
| 11,480,027 | B2 | 10/2022 | Beason et al. | |
| 11,480,028 | B2 | 10/2022 | Beason et al. | |
| 11,788,376 | B2 | 10/2023 | Beason et al. | |
| 11,867,023 | B2 | 1/2024 | Beason et al. | |
| 2011/0011593 | A1* | 1/2011 | Borhaug | E21B 7/124 166/311 |
| 2020/0040716 | A1* | 2/2020 | Clyburn | E21B 43/25 |
| 2020/0048991 | A1* | 2/2020 | Arteaga | E21B 47/06 |
| 2021/0355784 | A1* | 11/2021 | Kuehn | F16N 29/02 |

* cited by examiner

*Primary Examiner* — Giovanna Wright
(74) *Attorney, Agent, or Firm* — HAYNES AND BOONE, LLP

(57) ABSTRACT

An apparatus, system, and method according to which one or more sensors are adapted to detect a presence or absence of fluid entering, or before entering, a lubricator, within the lubricator, exiting, or after exiting, the lubricator, or any combination thereof, while fluid flow is received into the lubricator, the lubricator being operably coupled to a wellhead used in oil and gas operations. Based on the one or more sensors detecting the presence or absence of fluid, additional fluid flow into the lubricator is impeded.

30 Claims, 6 Drawing Sheets

VENT SUB FOR LUBRICATOR

BACKGROUND

The present application is related generally to lubricator systems, and, more particularly, to a vent sub for a lubricator used in oil and gas operations.

DETAILED DESCRIPTION

Figure 1:
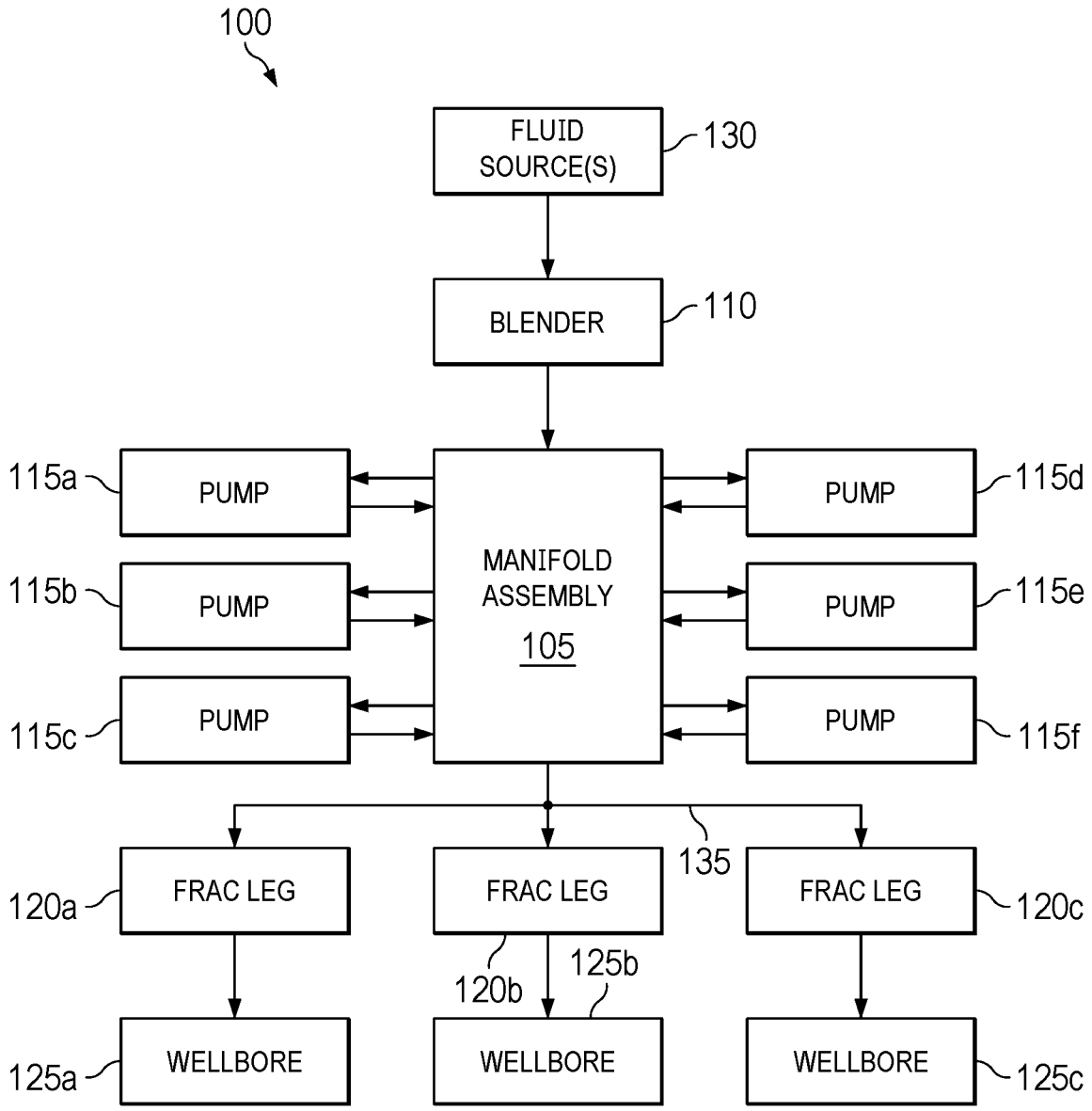
FIG. 1 is a diagrammatic illustration of a system, such as, for example, a hydraulic fracturing system, according to one or more embodiments.

Referring to FIG. 1, in one or more embodiments, a system is generally referred to by the reference numeral 100. The system 100 includes a manifold assembly 105. A blender 110 is in fluid communication with the manifold assembly 105, and one or more fluid sources 130 are in fluid communication with the blender 110, opposite the manifold assembly 105. Hydraulic fracturing pumps 115*a-f* are also in fluid communication with the manifold assembly 105. Each of the hydraulic fracturing pumps 115*a-f* is adapted to receive hydraulic fracturing fluid from the manifold assembly 105, pressurize the hydraulic fracturing fluid, and discharge the pressurized hydraulic fracturing fluid back to the manifold assembly 105. Fracturing (or "frac") legs 120*a-c* are also in fluid communication with the manifold assembly 105. Each of the frac legs 120*a-c* is adapted to receive the pressurized hydraulic fracturing fluid from the manifold assembly 105, via a zipper manifold 135. The frac legs 120*a-c* are further adapted to communicate the pressurized hydraulic fracturing fluid to wellbores 125*a-c*, respectively.

Figure 2:
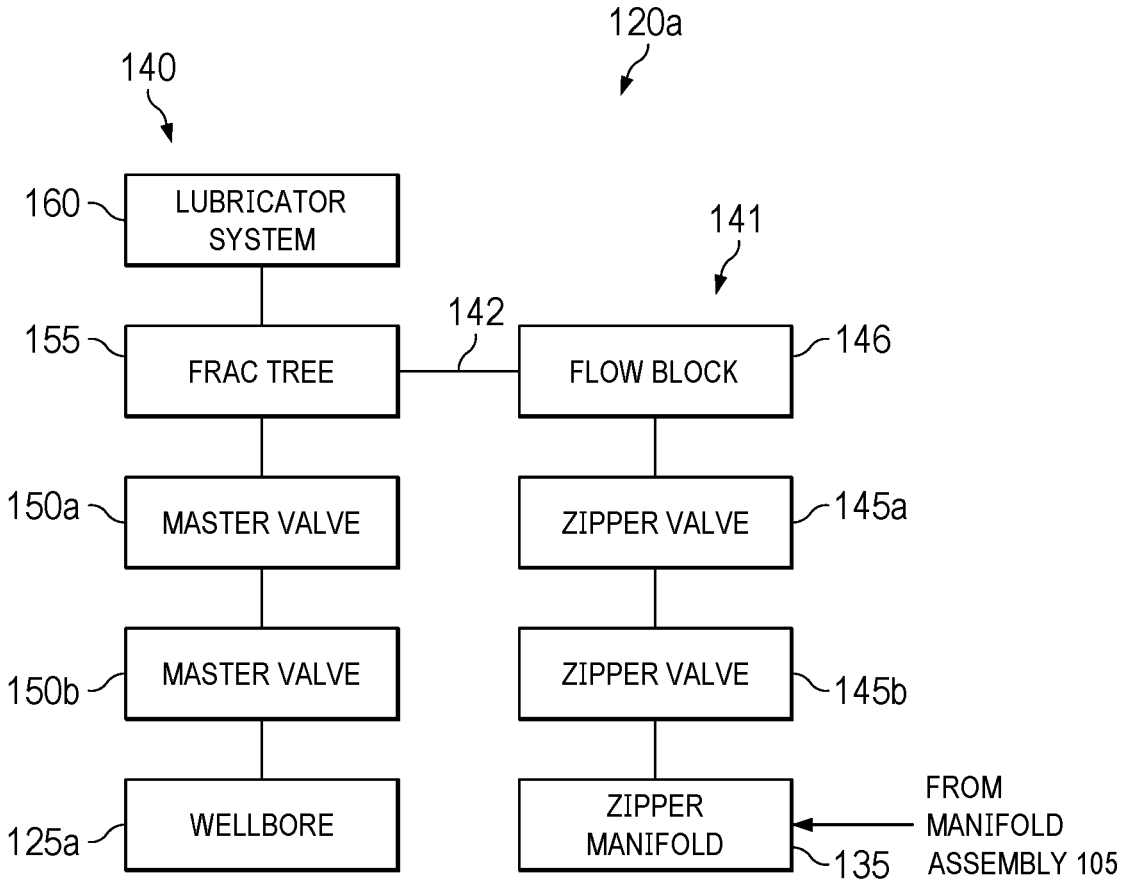
FIG. 2 is a diagrammatic illustration of a fracturing (or "frac") leg of the system of FIG. 1, according to one or more embodiments.

Referring to FIG. 2, with continuing reference to FIG. 1, in one or more embodiments, the frac leg 120*a* includes a wellhead 140, a zipper module 141, and a frac line 142 operably coupling the zipper module 141 to the wellhead 140. The zipper module 141 is operably coupled to, and adapted to receive the pressurized hydraulic fracturing fluid from, the zipper manifold 135. The zipper module 141 includes zipper valves 145*a-b* and a flow block 146. The zipper valve 145*b* is operably coupled to the zipper manifold 135. The zipper valve 145*a* is operably coupled to the zipper valve 145*b*, opposite the zipper manifold 135. In one or more embodiments, the zipper valves 145*a-b* are gate valves. The flow block 146 is operably coupled to the zipper valve 145*a*, opposite the zipper valve 145*b*. The frac line 142 is operably coupled to the flow block 146, opposite the zipper valve 145*a*. In one or more embodiments, at least a portion of the zipper module 141 is, includes, or is part of, the zipper manifold 135. For example, the flow block 146, the zipper valve 145*a*, the zipper valve 145*b*, or any combination thereof, may be, include, or be part of the zipper manifold 135.

The wellhead 140 serves as the surface termination of the wellbore 125*a*, and includes master valves 150*a-b* and a frac tree 155. The master valve 150*b* is in fluid communication with the wellbore 125*a*. The master valve 150*a* is operably coupled to the master valve 150*b*, opposite the wellbore 125*a*. In one or more embodiments, the master valves 150*a-b* are gate valves. The frac tree 155 is operably coupled to the master valve 150*a*, opposite the master valve 150*b*. The frac line 142 is operably coupled to the frac tree 155, opposite the master valve 150*a*. Thus, the frac line 142 is operably coupled between the flow block 146 of the zipper module 141 and the frac tree 155 of the wellhead 140, which frac tree 155 is adapted to be in fluid communication with the manifold assembly 105 via the frac line 142 and the zipper module 141. Additionally, a lubricator system 160 may be operably coupled to the frac tree 155, opposite the master valve 150*a* and the frac line 142, as will be described in further detail below. In one or more embodiments, the lubricator system 160 includes or is part of the frac tree 155.

The frac legs 120*b-c* are substantially identical to the frac leg 120*a*, and thus will not be described in further detail, except that corresponding features/components of the frac legs 120*b-c* will be given the same reference numerals as substantially identical features/components of the frac leg 120*a*.

The system 100 may be, include, or be part of, a hydraulic fracturing system, which may be used to facilitate a variety of oil and gas exploration and production operations. For example, the system 100 may be used to facilitate a hydraulic fracturing operation on the wellbore 125*a*, the wellbore 125*b*, the wellbore 125*c*, or any combination thereof. However, the system 100 is not limited to a hydraulic fracturing system, and may instead be adapted to facilitate a variety of other operations, such as, for example, a mud pump operation, a well treatment operation, another pumping operation, one or more operations at the wellheads 125*a-c* , one or more operations upstream of the wellheads 125*a-c* , one or more operations downstream of the wellheads 125*a-c* , and/or one or more other operations associated with the wellheads 125*a-c*.

Figure 3:
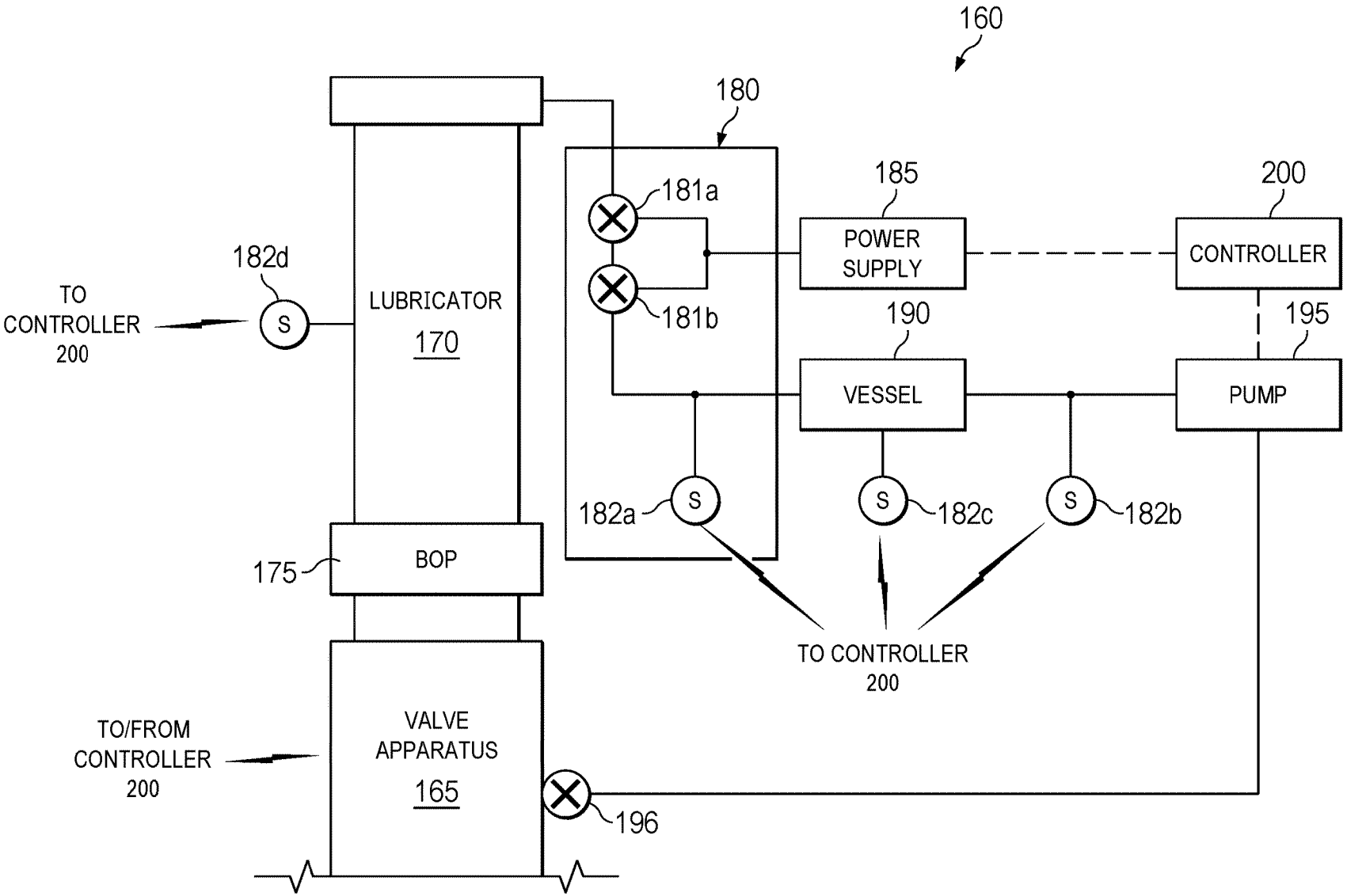
FIG. 3 is a diagrammatic illustration of a lubricator assembly of the system of FIGS. 1 and 2, the lubricator assembly including a vent sub, according to one or more embodiments.

Referring to FIG. 3, with continuing reference to FIG. 2, in one or more embodiments, the lubricator system 160 includes a valve apparatus 165 and a lubricator 170. The valve apparatus 165 is operably coupled to the frac tree 155 (shown in FIG. 2), opposite the master valve 150*a* and the frac line 142, and the lubricator 170 is operably coupled to the valve apparatus 165, opposite the frac tree 155. For example, the lubricator 170 may be operably coupled to the valve apparatus 165 via a latch (not shown). The lubricator 170 may also be extendable through a blowout preventer ("BOP") 175, a launcher (also not shown), or both, and, when so extended, attachable to the latch. The lubricator 170 may also be detachable from the latch in a similar manner, and, when so detached, retractable from the BOP 175 (and, optionally, the launcher).

In one or more embodiments, the valve apparatus 165, the lubricator 170, the BOP 175, the latch, the launcher, and the process of attaching the lubricator 170 to, and detaching the lubricator 170 from, the valve apparatus (via the latch) are described in: U.S. patent application Ser. No. 16/100,741, filed Aug. 10, 2018, now issued as U.S. Pat. No. 10,689,938, the entire disclosure of which is hereby incorporated herein by reference; U.S. patent application Ser. No. 16/855,749, filed Apr. 22, 2020, now issued as U.S. Pat. No. 11,480,027, the entire disclosure of which is hereby incorporated herein by reference; U.S. patent application Ser. No. 17/367,108, filed Jul. 2, 2021, now issued as U.S. Pat. No. 11,473,399, the entire disclosure of which is hereby incorporated herein by reference; U.S. patent application Ser. No. 18/047,085, filed Oct. 17, 2022, the entire disclosure of which is hereby incorporated herein by reference; U.S. patent application Ser. No. 17/319,854, filed May 13, 2021, the entire disclosure of which is hereby incorporated herein by reference; U.S. patent application Ser. No. 17/360,336, filed Jun. 28, 2021, now issued as U.S. Pat. No. 11,480,028, the entire disclosure of which is hereby incorporated herein by reference; U.S. patent application Ser. No. 16/248,633, filed Jan. 15, 2019, now issued as U.S. Pat. No. 10,584,552, the entire disclosure of which is hereby incorporated herein by reference; U.S. patent application Ser. No. 16/801,911, filed Feb. 26, 2020, now issued as U.S. Pat. No. 11,053,767, the entire disclosure of which is hereby incorporated herein by reference; U.S. patent application Ser. No. 16/803,156, filed Feb. 27, 2020, now issued as U.S. Pat. No. 11,242,724, the entire disclosure of which is hereby incorporated herein by reference; or any combination thereof.

A vent sub 180 is operably coupled to an end portion of the lubricator 170 opposite the valve apparatus 165. The vent sub 180 includes vent sub valves 181*a-b* and a sensor 182*a*. In one or more embodiments, the sensor 182*a* is adapted to detect a presence or absence of fluid. In one or more embodiments, the sensor 182*a* is or includes a flow switch. In one or more embodiments, the sensor 182*a* is or includes a radio frequency identification (RFID) reader adapted to detect one or more RFID tags in the fluid. In one or more embodiments, the sensor 182*a* is adapted to detect a presence or absence of fluid exiting, or after exiting, the lubricator 170. In one or more embodiments, the sensor 182*a* is adapted to detect a presence or absence of fluid entering, or before entering, the lubricator 170.

The vent sub valve 181*a* is operably coupled to the lubricator 170. For example, the vent sub valve 181*a* may be operably coupled to an end portion of the lubricator 170 opposite the valve apparatus 165. In one or more embodiments, the vent sub valve 181*a* is operably coupled to the lubricator 170 using a hose, such as, for example, a high pressure hose. The vent sub valve 181*b* is operably coupled to the vent sub valve 181*a*, opposite the lubricator 170. In one or more embodiments, the vent sub valves 181*a-b* are ball valves. An actuation mechanism 185 is adapted to actuate the vent sub valves 181*a-b*. The actuation mechanism 185 may be a pneumatic actuation mechanism (e.g., a compressor), a hydraulic actuation mechanism (e.g., a pump), an electric actuation mechanism (e.g., an electric power source), or any combination thereof. The sensor 182*a* is operably coupled to the vent sub valve 181*b*, opposite the vent sub valve 181*a*. However, although shown as being operably coupled to the vent sub valve 181*b*, opposite the vent sub valve 181*a*, the sensor 182*a* may instead be operably coupled between the vent sub valves 181*a-b*, or between the lubricator 170 and the vent sub valve 181*a*.

A vessel 190 is operably coupled to the sensor 182*a*, opposite the vent sub valve 181*b*. In one or more embodiments, the vessel 190 is or includes a tank. In one or more embodiments, the vessel 190 is operably coupled to the sensor 182*a* using a hose, such as, for example, a high pressure hose. The vent sub valves 181*a-b* provide a dual barrier between the lubricator 170 and the vessel 190. A fluid transport device ("FTD") 195 is operably coupled to the vessel 190, opposite the sensor 182*a*. In one or more embodiments, the FTD 195 is a peristaltic pump. However, the FTD 195 may be or include: another type of pump capable of pushing fluid; an accumulator; a pressurized vessel (which may be, include, or be part of, the vessel 190); the like; or any combination thereof. The FTD 195 is also operably coupled to lubricator 170 via the valve apparatus 165. However, although shown as being operably coupled to the lubricator 170 via the valve apparatus 165, the FTD 195 may instead be operably coupled to the lubricator 170 via another component of the lubricator system 160 (e.g., the latch, the launcher, the BOP, etc.), or the FTD 195 may be operably coupled directly to the lubricator 170.

In addition to, or instead of, the sensor 182*a*, the lubricator system 160 may include a sensor 182*b*. In one or more embodiments, the sensor 182*b* is adapted to detect a presence or absence of fluid. In one or more embodiments, the sensor 182*b* is operably coupled between the vessel 190 and the FTD 195. However, although shown as being operably coupled between the vessel 190 and the FTD 195, the sensor 182*b* may instead be operably coupled to the FTD 195, opposite the vessel 190, or operably coupled directly to the FTD 195. In one or more embodiments, the sensor 182*b* is or includes a flow switch. In one or more embodiments, the sensor 182*b* is or includes an RFID reader adapted to detect one or more RFID tags in the fluid. In one or more embodiments, the sensor 182*b* is part of the vent sub 180. In one or more embodiments, the sensor 182*b* is adapted to detect a presence or absence of fluid entering, or before entering, the lubricator 170. In one or more embodiments, the sensor 182*b* is adapted to detect a presence or absence of fluid exiting, or after exiting, the lubricator 170.

Further, in addition to, or instead of, the sensor(s) 182*a-b*, the lubricator system 160 may include a sensor 182*c*. In one or more embodiments, the sensor 182*c* is adapted to detect a presence or absence of fluid within the vessel 190. For example, the sensor 182*c* may be adapted to detect an amount of fluid within the vessel 190. In one or more embodiments, the sensor 182*c* is operably coupled to the vessel 190. For example, the sensor 182*c* may extend within the vessel 190. In one or more embodiments, the sensor 182*c* is or includes a fluid level sensor. In one or more embodiments, the sensor 182*c* is or includes a scale (i.e., a mass or weight sensor). In one or more embodiments, the sensor 182*c* is or includes an RFID reader adapted to detect one or more RFID tags in the fluid. In one or more embodiments, the sensor 182*c* is adapted to detect a presence or absence of fluid entering, or before entering, the lubricator 170. In one or more embodiments, the sensor 182*c* is adapted to detect a presence or absence of fluid exiting, or after exiting, the lubricator 170.

Finally, in addition to, or instead of, the sensor(s) 182*a-c*, the lubricator system 160 may include a sensor 182*d*. In one or more embodiments, the sensor 182*d* is adapted to detect a presence or absence of fluid: entering, or before entering, the lubricator 170; within the lubricator 170; exiting, or after exiting the lubricator 170; or any combination thereof. For example, the sensor 180*d* may detect an amount of fluid within the lubricator 170. In one or more embodiments, the sensor 182*d* is operably coupled to the lubricator 170. For example, the sensor 182*d* may extend within the lubricator 170. In one or more embodiments, the sensor 182*d* is or includes a fluid level sensor. In one or more embodiments, the sensor 182*d* is or includes a flow switch. In one or more embodiments, the sensor 182 is or includes a radio frequency identification (RFID) reader adapted to detect one or more RFID tags in the fluid.

A controller 200 is adapted to communicate signal(s) to, and/or receive signal(s) from, the sensors 182*a-d*, the actuation mechanism 185, and the FTD 195. In addition, the controller 200 may be adapted to communicate signal(s) to, and/or receive signal(s) from, the valve apparatus 165. In this regard, although shown as being separate from the valve apparatus 165, in one or more embodiments, the controller 200 includes or is part of the valve apparatus 165.

In operation, the lubricator system 160 deploys one or more downhole tools (e.g., a plug and perforating guns) from the lubricator 170 to the wellbore 125*a* on a conveyance string (e.g., wireline), and retrieves at least a portion of the one or more downhole tools from the wellbore 125*a*. To initiate deployment of the one or more downhole tools from the lubricator 170, the controller 200 opens (or keeps open) a drain valve 196, starts the FTD 195, and opens (or keeps open) the vent sub valves 181*a-b*. In one or more embodiments, the drain valve 196 is part of (or at least associated with) the valve apparatus 165. In other embodiments, the drain valve 196 is part of (or at least associated with) another component of the lubricator system 160 (e.g., the latch, the launcher, the BOP, etc.), or the drain valve 196 is part of (or at least associated with) the lubricator 170. The FTD 195 fills the lubricator 170 with fluid via the open drain valve 196. In one or more embodiments, the FTD 195 fills the lubricator 170 with fluid from the vessel 190. The vent sub valves 181*a-b* are kept open while the FTD 195 fills the lubricator 170. For example, the controller 200 may cause the vent sub valves 181*a-b* to open (or stay open) by sending control signal(s) to (or withholding control signal(s) from) the actuation mechanism 185. Additionally, or alternatively, the controller 200 may cause the vent sub valves 181*a-b* to open (or stay open) by sending control signal(s) directly to (or withholding control signal(s) from) the vent sub valves 181*a-b*.

Once the lubricator 170 is filled, fluid overflows the lubricator 170 through the open vent sub valves 181*a-b* and the sensor 182*a*. In one or more embodiments, fluid overflows the lubricator 170 into the vessel 190 via the open vent sub valves 181*a-b* and the sensor 182*a*. The fluid overflowing the lubricator 170 through the open vent sub valves 181*a-b* and the sensor 182*a* causes the sensor 182*a* to change state. As a result, the sensor 182*a* communicates signal(s) to the controller 200, which are interpreted by the controller 200 as indicating that the fill process is complete. Additionally, or alternatively, the sensor 182*b*, the sensor 182*c*, the sensor 182*d*, or any combination thereof, may change state during the lubricator 170 fill process, causing said sensor(s) to communicate signal(s) to the controller 200, which are interpreted by the controller 200 as indicating that the fill process is complete. In addition, or instead, the signal(s) communicated by the sensor 182*b*, the sensor 182*c*, the sensor 182*d*, or the any combination thereof, may be used to verify whether or not the signal(s) received from the sensor 182*a* were generated due to a false reading (e.g., due to "sputtering" flow during filling of the lubricator 170). For example, if the signal(s) received from the sensor 182*c* indicate that the vessel 190 contains too much fluid for the lubricator 170 to have yet been filled, the controller 200 disregards the signal(s) received from the sensor 182*a* as a false reading.

In any case, the controller 200 stops the FTD 195, closes the drain valve 196, and closes the vent sub valves 181*a-b* based on the signal(s) received from the sensor(s). For example, the controller 200 may cause the vent sub valves 181*a-b* to close by sending control signal(s) to (or withholding control signal(s) from) the actuation mechanism 185. Additionally, or alternatively, the controller 200 may cause the vent sub valves 181*a-b* to close by sending control signal(s) directly to (or withholding control signal(s) from) the vent sub valves 181*a-b*. In one or more embodiments, the controller 200 effects a time delay after receiving the signal(s) from the sensor(s) to ensure that the fill process is complete before stopping the FTD 195, closing the drain valve 196, and/or closing the vent sub valves 181*a-b*. The one or more downhole tools can be deployed and retrieved as described above once the fill process is complete.

After the one or more downhole tools have been deployed and retrieved as described above, a drain process is initiated. The controller 200 opens the drain valve 196 to drain fluid from the lubricator 170. In one or more embodiments, fluid is drained from the lubricator 170 into the vessel 190. In one or more embodiments, the controller 200 also starts the FTD 195 to assist in draining fluid from the lubricator 170. As fluid drains from the lubricator 170, some residual fluid remains in the line between the vent sub valve 181*a* and the lubricator 170. In one or more embodiments, the controller 200 opens the vent sub valves 181*a-b* to drain the residual fluid remaining in the line between the vent sub valve 181*a* and the lubricator 170. The draining of this residual fluid is detected by the sensor 182, but only for a brief time until the line between the vent sub valve 181*a* and the lubricator 170 has been completely drained. Thus, the controller 200 takes no responsive action, and instead monitors feedback from another sensor (not shown) associated with an output of the drain valve 196. For example, the another sensor may be operably associated with an output of the FTD 195 back to the vessel 190. The controller 200 terminates the drain process, based on feedback from the another sensor (e.g., the another sensor no longer detects fluid flow), by stopping the FTD 195, closing the drain valve 196, and closing the vent sub valves 181*a-b*.

Figure 4:
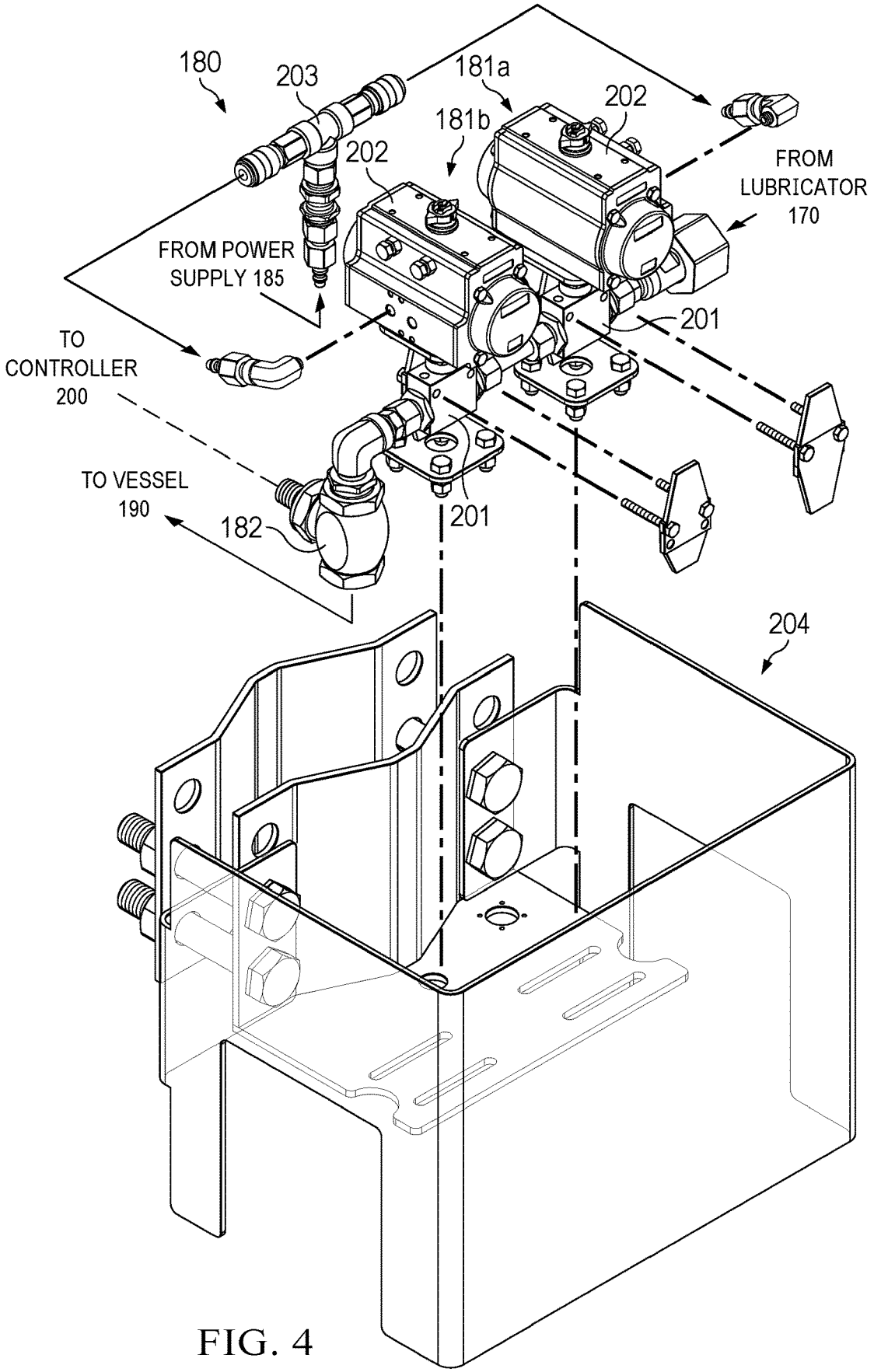
FIG. 4 is an exploded perspective view of the vent sub of FIG. 3, according to one or more embodiments.

Referring to FIG. 4, with continuing reference to FIG. 3, a perspective view of the vent sub 180 is illustrated according to one or more embodiments, in which each of the vent sub valves 181*a-b* includes a valve 201 and an actuator 202. In one or more embodiments, the actuators 201 are pneumatic actuators and the actuation mechanism 185 (shown in FIG. 3) is a pneumatic actuation mechanism. In such embodiments, a fitting 203 operably couples the pneumatic actuation mechanism 185 to the pneumatic actuators 201. In addition, or instead, one or both of the actuators 201 may be hydraulic actuator(s) and the actuation mechanism 185 may be or include a pneumatic actuation mechanism. In addition, or instead, one or both of the actuators 201 may be electric actuator(s) and the actuation mechanism 185 may be or include an electric actuation mechanism. A support bracket 204 is adapted to attach the vent sub valves 181*a-b* and the sensor 182 to the lubricator 170 (shown in FIG. 3).

Figure 5:
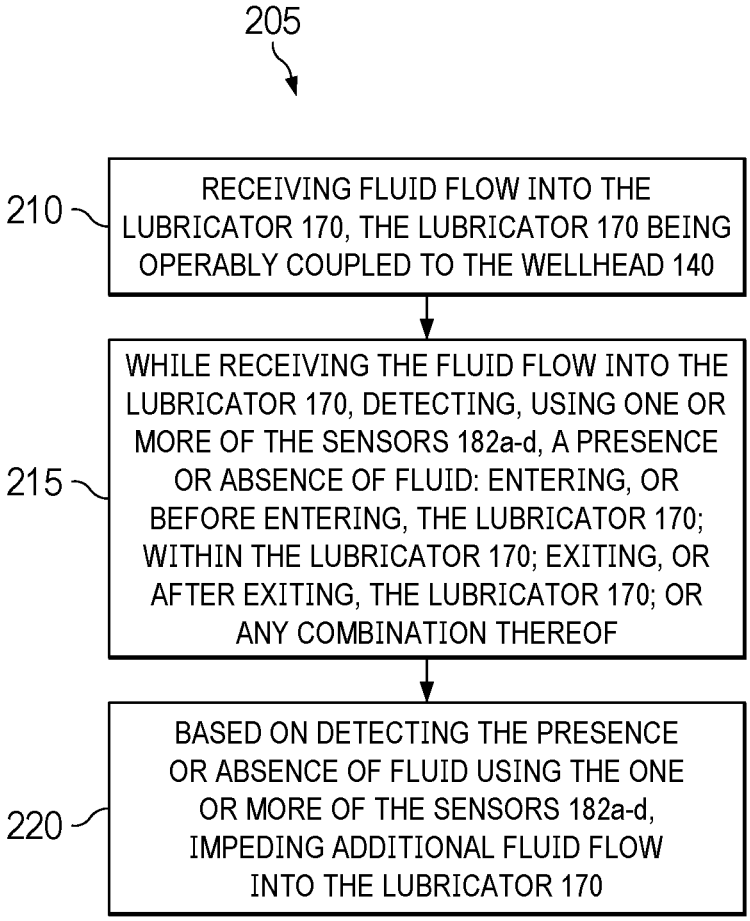
FIG. 5 is a flow diagram of a method for implementing one or more embodiments of the present disclosure.

Referring to FIG. 5, with continuing reference to FIGS. 1-4, in one or more embodiments, a method is generally referred to by the reference numeral 205 and includes: at a step 210, receiving fluid flow into the lubricator 170, the lubricator being operably coupled to the wellhead 140; at a step 215, while receiving the fluid flow into the lubricator 170, detecting, using one or more of the sensors 182*a-d*, a presence or absence of fluid: entering, or before entering, the lubricator 170, within the lubricator 170, exiting, or after exiting, the lubricator 170, or any combination thereof; and at a step 220, based on detecting the presence or absence of fluid using the one or more of the sensors 182*a-d*, impeding additional fluid flow into the lubricator 170. In one or more embodiments, at least one of the one or more of the sensors 182*a-d*, detects an overflow of fluid from the lubricator 170 at the step 215. In one or more embodiments, the fluid flow is received into the lubricator 170 through the drain valve 196 at the step 210, and impeding the additional fluid flow into the lubricator 170 at the step 220 includes closing the drain valve 196. In one or more embodiments, the method 205 further includes opening the drain valve 196 before receiving the first fluid flow into the lubricator 170 through the drain valve 196. In one or more embodiments, impeding the additional fluid flow into the lubricator 170 at the step 220 comprises stopping, or at least slowing, the FTD 195. In one or more embodiments, the fluid flow is received into the lubricator 170 at the step 210 from the FTD 195. In one or more embodiments, an overflow of fluid from the lubricator 170 is received at the step 215 through the vent sub valves 181*a-b*, and impeding the additional fluid flow into the lubricator 170 at the step 220 comprises closing the vent sub valves 181*a-b*. In one or more embodiments, the method 205 further includes opening the vent sub valves 181*a-b* before the overflow of fluid from the lubricator 170 is received through the vent sub valves 181*a-b*.

Figure 6:
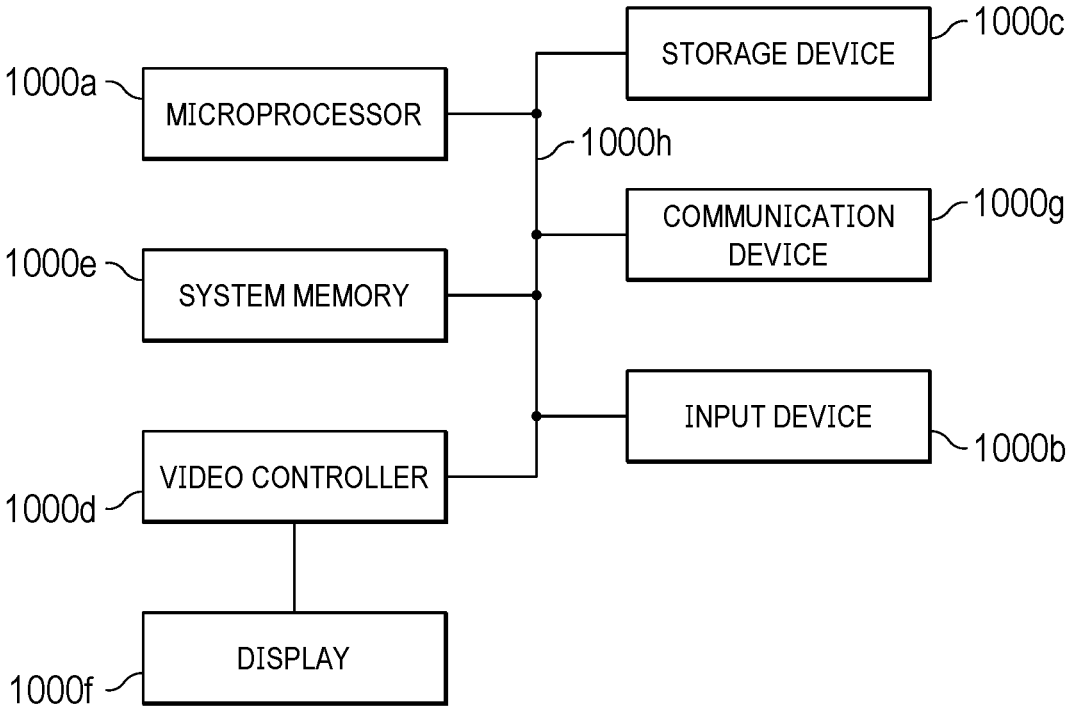
FIG. 6 is a diagrammatic illustration of a computing node for implementing one or more embodiments of the present disclosure.

Referring to FIG. 6, with continuing reference to FIGS. 1-5, in one or more embodiments, a computing node 1000 for implementing one or more embodiments of one or more of the above-described element(s), component(s), system(s), apparatus, method(s), step(s), and/or controller(s), and/or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In one or more embodiments, the microprocessor 1000*a* is, includes, or is part of, the controller 200 described herein. In one or more embodiments, the storage device 1000*c* may include a floppy drive, hard drive, CD-ROM, optical drive, any other form of storage device or any combination thereof. In one or more embodiments, the storage device 1000*c* may include, and/or be capable of receiving, a floppy disk, CD-ROM, DVD-ROM, or any other form of computer-readable medium that may contain executable instructions. In one or more embodiments, the communication device 1000*g* may include a modem, network card, or any other device to enable the node 1000 to communicate with other nodes. In one or more embodiments, any node represents a plurality of interconnected (whether by intranet or Internet) computer systems, including without limitation, personal computers, mainframes, PDAs, smartphones and cell phones.

In one or more embodiments, one or more of the components of any of the above-described systems include at least the node 1000 and/or components thereof, and/or one or more nodes that are substantially similar to the node 1000 and/or components thereof. In one or more embodiments, one or more of the above-described components of the node 1000 and/or the above-described systems include respective pluralities of same components.

In one or more embodiments, a computer system typically includes at least hardware capable of executing machine readable instructions, as well as the software for executing acts (typically machine-readable instructions) that produce a desired result. In one or more embodiments, a computer system may include hybrids of hardware and software, as well as computer sub-systems.

In one or more embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In one or more embodiments, hardware may include any physical device that is capable of storing machine-readable instructions, such as memory or other data storage devices. In one or more embodiments, other forms of hardware include hardware sub-systems, including transfer devices such as modems, modem cards, ports, and port cards, for example.

In one or more embodiments, software includes any machine code stored in any memory medium, such as RAM or ROM, and machine code stored on other devices (such as floppy disks, flash memory, or a CD ROM, for example). In one or more embodiments, software may include source or object code. In one or more embodiments, software encompasses any set of instructions capable of being executed on a node such as, for example, on a client machine or server.

In one or more embodiments, combinations of software and hardware could also be used for providing enhanced functionality and performance for certain embodiments of the present disclosure. In one or more embodiments, software functions may be directly manufactured into a silicon chip. Accordingly, combinations of hardware and software are also included within the definition of a computer system and are thus envisioned by the present disclosure as possible equivalent structures and equivalent methods.

In one or more embodiments, computer readable mediums include, for example, passive data storage, such as a random-access memory (RAM) as well as semi-permanent data storage such as a compact disk read only memory (CD-ROM). One or more embodiments of the present disclosure may be embodied in the RAM of a computer to transform a standard computer into a new specific computing machine. In one or more embodiments, data structures are defined organizations of data that may enable one or more embodiments of the present disclosure. In one or more embodiments, data structure may provide an organization of data, or an organization of executable code.

In one or more embodiments, any networks and/or one or more portions thereof, may be designed to work on any specific architecture. In one or more embodiments, one or more portions of any networks may be executed on a single computer, local area networks, client-server networks, wide area networks, internets, hand-held and other portable and wireless devices and networks.

In one or more embodiments, database may be any standard or proprietary database software. In one or more embodiments, the database may have fields, records, data, and other database elements that may be associated through database specific software. In one or more embodiments, data may be mapped. In one or more embodiments, mapping is the process of associating one data entry with another data entry. In one or more embodiments, the data contained in the location of a character file can be mapped to a field in a second table. In one or more embodiments, the physical location of the database is not limiting, and the database may be distributed. In one or more embodiments, the database may exist remotely from the server, and run on a separate platform. In one or more embodiments, the database may be accessible across the Internet. In one or more embodiments, more than one database may be implemented.

In one or more embodiments, a plurality of instructions stored on a non-transitory computer readable medium may be executed by one or more processors to cause the one or more processors to carry out or implement in whole or in part the above-described operation of each of the above-described element(s), component(s), system(s), apparatus, method(s), step(s), and/or controller(s), and/or any combination thereof. In one or more embodiments, such a processor may be or include one or more of the microprocessor 1000*a*, one or more controllers (such as, for example, the controller 200), one or more other controllers, any processor(s) that are part of the components of the above-described systems, and/or any combination thereof, and such a computer readable medium may be distributed among one or more components of the above-described systems. In one or more embodiments, such a processor may execute the plurality of instructions in connection with a virtual computer system. In one or more embodiments, such a plurality of instructions may communicate directly with the one or more processors, and/or may interact with one or more operating systems, middleware, firmware, other applications, and/or any combination thereof, to cause the one or more processors to execute the instructions.

A method has been disclosed. The method generally includes: receiving fluid flow into the lubricator, the lubricator being operably coupled to a wellhead; while receiving the fluid flow into the lubricator, detecting, using one or more sensors, a presence or absence of fluid: entering, or before entering, the lubricator; within the lubricator; exiting, or after exiting, the lubricator; or any combination thereof; and based on detecting the presence or absence of fluid using the one or more sensors, impeding additional fluid flow into the lubricator. In one or more embodiments, at least one of the one or more sensors detects an overflow of fluid from the lubricator. In one or more embodiments, the fluid flow is received into the lubricator through one or more valves; and impeding additional fluid flow into the lubricator includes closing the one or more valves. In one or more embodiments, the method further includes opening the one or more valves before receiving the fluid flow into the lubricator through the one or more valves. In one or more embodiments, impeding additional fluid flow into the lubricator includes stopping, or at least slowing, a fluid transport device ("FTD"). In one or more embodiments, the fluid flow is received into the lubricator from the FTD. In one or more embodiments, an overflow of fluid from the lubricator is received through one or more valves; and impeding additional fluid flow into the lubricator includes closing the one or more valves. In one or more embodiments, the method further includes opening the one or more valves before the overflow of fluid from the lubricator is received through the one or more valves.

A first system has also been disclosed. The first system generally includes: a lubricator operably coupled to a wellhead and into which fluid flow is adapted to be received; one or more sensors adapted to detect, while the fluid flow is received into the lubricator, a presence or absence of fluid: entering, or before entering, the lubricator; within the lubricator; exiting, or after exiting, the lubricator; or any combination thereof; and a controller adapted to cause, based on detection of the presence or absence of fluid by the one or more sensors, impedance of additional fluid flow into the lubricator. In one or more embodiments, at least one of the one or more sensors is adapted to detect an overflow of fluid from the lubricator. In one or more embodiments, the first system further includes one or more valves through which the fluid flow is adapted to be received into the lubricator; wherein the controller is adapted to cause impedance of additional fluid flow into the lubricator by closing the one or more valves. In one or more embodiments, the one or more valves are further adapted to open to permit the first fluid flow to be received therethrough and into the lubricator. In one or more embodiments, the first system further includes a fluid transport device ("FTD") adapted to transport the first fluid flow into the lubricator. In one or more embodiments, the controller is adapted to cause impedance of additional fluid flow into the lubricator by stopping, or at least slowing down, the FTD. In one or more embodiments, the first system further includes one or more valves through which an overflow of fluid from the lubricator is adapted to be received; wherein the controller is adapted to cause impedance of additional fluid flow into the lubricator by closing the one or more valves. In one or more embodiments, the one or more valves are further adapted to open to permit the overflow of fluid from the lubricator to be received therethrough.

An apparatus has also been disclosed. The apparatus generally includes: a non-transitory computer readable medium; and a plurality of instructions stored on the non-transitory computer readable medium and executable by one or more processors to implement the following steps: receiving fluid flow into the lubricator, the lubricator being operably coupled to a wellhead; while receiving the fluid flow into the lubricator, detecting, using one or more sensors, a presence or absence of fluid: entering, or before entering, the lubricator; within the lubricator; exiting, or after exiting, the lubricator; or any combination thereof; and based on detecting the presence or absence of fluid using the one or more sensors, impeding additional fluid flow into the lubricator. In one or more embodiments, at least one of the one or more sensors detects an overflow of fluid from the lubricator. In one or more embodiments, the fluid flow is received into the lubricator through one or more valves; and impeding additional fluid flow into the lubricator includes closing the one or more valves. In one or more embodiments, the plurality of instructions are executable by one or more processors to implement the following additional step: opening the one or more valves before receiving the fluid flow into the lubricator through the one or more valves. In one or more embodiments, impeding additional fluid flow into the lubricator includes stopping, or at least slowing, a fluid transport device ("FTD"). In one or more embodiments, the fluid flow is received into the lubricator from the FTD. In one or more embodiments, an overflow of fluid from the lubricator is received through one or more valves; and impeding additional fluid flow into the lubricator includes closing the one or more valves. In one or more embodiments, the plurality of instructions are executable by one or more processors to implement the following additional step: opening the one or more valves before the overflow of fluid from the lubricator is received through the one or more valves.

A second system has also been disclosed. The second system generally includes: one or more sensors adapted to detect, while fluid flow is received into a lubricator operably coupled to a wellhead, a presence or absence of fluid: entering, or before entering, the lubricator; within the lubricator; exiting, or after exiting, the lubricator; or any combination thereof; and one or more first valves through which an overflow of fluid from the lubricator is adapted to be received, the one or more first valves being actuable, to impede additional fluid flow into the lubricator, based on the one or more sensors detecting the presence or absence of fluid. In one or more embodiments, at least one of the one or more sensors is adapted to detect the overflow of fluid from the lubricator. In one or more embodiments, the second system further includes one or more second valves through which the fluid flow is adapted to be received into the lubricator. In one or more embodiments, the one or more second valves are actuable, to further impede additional fluid flow into the lubricator, based on the one or more sensors detecting the presence or absence of fluid. In one or more embodiments, the system further includes a fluid transport device ("FTD") adapted to transport the fluid flow into the lubricator. In one or more embodiments, the FTD is adapted to stop, or at least slow down, to further impede additional fluid flow into the lubricator, based on the one or more sensors detecting the presence or absence of fluid.

It is understood that variations may be made in the foregoing without departing from the scope of the present disclosure.

In one or more embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, and/or one or more of the procedures may also be performed in different orders, simultaneously and/or sequentially. In one or more embodiments, the steps, processes, and/or procedures may be merged into one or more steps, processes and/or procedures.

In one or more embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A method, comprising:

receiving fluid flow into a lubricator, the lubricator being operably coupled to a wellhead;

while receiving the fluid flow into the lubricator, detecting, using one or more first sensors, a presence or absence of fluid exiting, or after exiting, the lubricator, in response to detecting the presence or absence of fluid using the one or more first sensors, communicating one or more first signals from the one or more first sensors to a controller, detecting, using one or more second sensors, a presence or absence of fluid:

entering, or before entering, the lubricator; and/or within the lubricator, and in response to detecting the presence or absence of fluid using the one or more second sensors, communicating one or more second signals from the one or more second sensors to the controller;

verifying, using the controller and based on the one or more second signals received from the one or more second sensors, that the one or more first signals received from the one or more first sensors were not generated due to false reading(s); and in response to verifying that the one or more first signals received from the one or more first sensors were not generated due to false reading(s), impeding additional fluid flow into the lubricator.

2. The method of claim 1, wherein at least one of the one or more first sensors detects an overflow of fluid from the lubricator.

3. The method of claim 1, wherein the fluid flow is received into the lubricator through one or more valves; and wherein impeding additional fluid flow into the lubricator comprises closing the one or more valves.

4. The method of claim 3, further comprising:

opening the one or more valves before receiving the fluid flow into the lubricator through the one or more valves.

5. The method of claim 1, wherein impeding additional fluid flow into the lubricator comprises stopping, or at least slowing, a fluid transport device ("FTD").

6. The method of claim 5, wherein the fluid flow is received into the lubricator from the FTD.

7. The method of claim 1, wherein an overflow of fluid from the lubricator is received through one or more valves; and wherein impeding additional fluid flow into the lubricator comprises closing the one or more valves.

8. The method of claim 7, further comprising:

opening the one or more valves before the overflow of fluid from the lubricator is received through the one or more valves.

9. A system, comprising:

a lubricator operably coupled to a wellhead and into which fluid flow is adapted to be received;

one or more first sensors adapted to:

detect, while the fluid flow is received into the lubricator, a presence or absence of fluid exiting, or after exiting, the lubricator, and in response to detecting the presence or absence of fluid, communicate one or more first signals to a controller;

one or more second sensors adapted to:

detect, while the fluid flow is received into the lubricator, a presence or absence of fluid:

entering, or before entering, the lubricator; and/or within the lubricator, and in response to detecting the presence or absence of fluid, communicate one or more second signals to the controller;

and the controller, which is adapted to:

verify, based on the one or more second signals received from the one or more second sensors, that the one or more first signals received from the one or more first sensors were not generated due to false reading(s); and in response to verifying that that the one or more first signals received from the one or more first sensors were not generated due to false reading(s), cause impedance of additional fluid flow into the lubricator.

10. The system of claim 9, wherein at least one of the one or more first sensors is adapted to detect an overflow of fluid from the lubricator.

11. The system of claim 9, further comprising:

one or more valves through which the fluid flow is adapted to be received into the lubricator;

wherein the controller is adapted to cause impedance of additional fluid flow into the lubricator by closing the one or more valves.

12. The system of claim 11, wherein the one or more valves are further adapted to open to permit the first fluid flow to be received therethrough and into the lubricator.

13. The system of claim 9, further comprising:

a fluid transport device ("FTD") adapted to transport the first fluid flow into the lubricator.

14. The system of claim 13, wherein the controller is adapted to cause impedance of additional fluid flow into the lubricator by stopping, or at least slowing down, the FTD.

15. The system of claim 9, further comprising:

one or more valves through which an overflow of fluid from the lubricator is adapted to be received;

wherein the controller is adapted to cause impedance of additional fluid flow into the lubricator by closing the one or more valves.

16. The system of claim 15, wherein the one or more valves are further adapted to open to permit the overflow of fluid from the lubricator to be received therethrough.

17. An apparatus, comprising:

a non-transitory computer readable medium; and a plurality of instructions stored on the non-transitory computer readable medium and executable by one or more processors to implement the following steps:

receiving fluid flow into a lubricator, the lubricator being operably coupled to a wellhead;

while receiving the fluid flow into the lubricator, detecting, using one or more first sensors, a presence or absence of fluid exiting, or after exiting, the lubricator, in response to detecting the presence or absence of fluid using the one or more first sensors, communicating one or more first signals from the one or more first sensors to a controller, detecting, using one or more second sensors, a presence or absence of fluid:

entering, or before entering, the lubricator; and/or within the lubricator, and in response to detecting the presence or absence of fluid using the one or more second sensors, communicating one or more second signals from the one or more second sensors to the controller;

verifying, using the controller and based on the one or more second signals received from the one or more second sensors, that the one or more first signals received from the one or more first sensers were not generated due to false reading(s); and in response to verifying that the one or more first signals received from the one or more first sensors were not generated due to false reading(s), impeding additional fluid flow into the lubricator.

18. The apparatus of claim 17, wherein at least one of the one or more first sensors detects an overflow of fluid from the lubricator.

19. The apparatus of claim 17, wherein the fluid flow is received into the lubricator through one or more valves; and wherein impeding additional fluid flow into the lubricator comprises closing the one or more valves.

20. The apparatus of claim 19, wherein the plurality of instructions are executable by one or more processors to implement the following additional step:

opening the one or more valves before receiving the fluid flow into the lubricator through the one or more valves.

21. The apparatus of claim 17, wherein impeding additional fluid flow into the lubricator comprises stopping, or at least slowing, a fluid transport device ("FTD").

22. The apparatus of claim 21, wherein the fluid flow is received into the lubricator from the FTD.

23. The apparatus of claim 17, wherein an overflow of fluid from the lubricator is received through one or more valves; and wherein impeding additional fluid flow into the lubricator comprises closing the one or more valves.

24. The apparatus of claim 23, wherein the plurality of instructions are executable by one or more processors to implement the following additional step:

opening the one or more valves before the overflow of fluid from the lubricator is received through the one or more valves.

25. A system, comprising:

one or more first sensors adapted to;

detect, while fluid flow is received into a lubricator operably coupled to a wellhead, a presence or absence of fluid exiting, or after exiting, the lubricator, and in response to detecting the presence or absence of fluid, communicate one or more first signals to a controller;

one or more second sensors adapted to:

detect, while the fluid flow is received into the lubricator operably coupled to the wellhead, a presence or absence of fluid:

entering, or before entering the lubricator; and/or within the lubricator, and in response to detecting the presence or absence of fluid, communicate one or more second signals to the controller;

and the controller, which is adapted to:

verify, based on the one or more second signals received from the one or more second sensors, that the one or more first signals received from the one or more first sensors were not generated due to false signal(s); and in response to verifying that the one or more first signals received from the one or more first sensors were not generated due to false signal(s), actuate one or more first valves through which an overflow of fluid from the lubricator is adapted to be received in order to impede additional fluid flow into the lubricator.

26. The system of claim 25, wherein at least one of the one or more first sensors is adapted to detect the overflow of fluid from the lubricator.

27. The system of claim 25, further comprising:

one or more second valves through which the fluid flow is adapted to be received into the lubricator.

28. The system of claim 27, wherein the one or more second valves are actuable, to further impede additional fluid flow into the lubricator, based on the one or more first sensors and the one or more second sensors detecting the presence or absence of fluid.

29. The system of claim 25, further comprising:

a fluid transport device ("FTD") adapted to transport the fluid flow into the lubricator.

30. The system of claim 29, wherein the FTD is adapted to stop, or at least slow down, to further impede additional fluid flow into the lubricator, based on the one or more first sensors and the one or more second sensors detecting the presence or absence of fluid.

* * * * *